US008608904B1

(12) United States Patent
Tucker et al.

(10) Patent No.: US 8,608,904 B1
(45) **Date of Patent: *Dec. 17, 2013**

(54) CREPING ADHESIVE MODIFIER AND METHODS FOR PRODUCING PAPER PRODUCTS

(75) Inventors: Stephen H. Tucker, Clarkston, WA (US); Douglas S. Smalley, Portland, OR (US)

(73) Assignee: Clearwater Specialties, LLC, Clarkston, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/437,724

(22) Filed: Apr. 2, 2012

Related U.S. Application Data

(63) Continuation of application No. 12/825,079, filed on Jun. 28, 2010, now Pat. No. 8,147,649, which is a continuation of application No. 11/454,360, filed on Jun. 15, 2006, now Pat. No. 7,744,722.

(51) Int. Cl.
*B31F 1/12* (2006.01)

(52) U.S. Cl.
USPC ..... 162/112; 162/111; 162/135; 162/158; 162/168.1; 156/183; 264/282; 264/283

(58) Field of Classification Search
USPC ..... 162/111–113, 164.1, 168.1, 135, 158; 156/183; 264/282–283
See application file for complete search history.

(56) References Cited

U.S. PATENT DOCUMENTS

| | | | | |
|---|---|---|---|---|
| 3,014,832 | A | 12/1961 | Donnelly | |
| 3,640,841 | A | 2/1972 | Winslow et al. | |
| 4,054,709 | A | 10/1977 | Belitsin et al. | |
| 4,131,955 | A | 1/1979 | Haigh | |
| 4,440,898 | A | 4/1984 | Pomplun et al. | |
| 4,851,278 | A | 7/1989 | Enanoza | |
| 4,994,146 | A | 2/1991 | Soerens | |
| 5,025,046 | A | 6/1991 | Soerens | |
| 5,187,219 | A | 2/1993 | Furman, Jr. | |
| 5,217,576 | A | 6/1993 | Van Phan | |
| 5,223,096 | A | 6/1993 | Phan et al. | |
| 5,246,544 | A | 9/1993 | Hollenberg et al. | |
| 5,246,545 | A | 9/1993 | Ampulski et al. | |
| 5,246,762 | A | 9/1993 | Nakamura | |
| 5,281,208 | A | 1/1994 | Thompson et al. | |
| 5,324,561 | A | 6/1994 | Rezai et al. | |
| 5,338,807 | A | 8/1994 | Espy et al. | |
| 5,382,323 | A | 1/1995 | Furman, Jr. et al. | |
| 5,575,891 | A | 11/1996 | Trokhan et al. | |
| 5,624,532 | A | 4/1997 | Trokhan et al. | |
| 5,660,687 | A | 8/1997 | Allen et al. | |
| 5,833,806 | A | 11/1998 | Allen et al. | |
| 5,981,645 | A | 11/1999 | Hollenberg et al. | |
| 6,048,938 | A | 4/2000 | Neal et al. | |
| 6,080,686 | A * | 6/2000 | Floyd | 442/102 |
| 6,280,571 | B1 | 8/2001 | Allen | |
| 6,562,479 | B1 | 5/2003 | Smalley et al. | |
| 6,663,942 | B1 | 12/2003 | Luu et al. | |
| 6,689,250 | B1 | 2/2004 | Luu et al. | |
| 6,699,359 | B1 | 3/2004 | Luu et al. | |
| 6,808,597 | B2 | 10/2004 | Allen | |
| 6,812,281 | B2 | 11/2004 | Luu et al. | |
| 6,815,497 | B1 | 11/2004 | Luu et al. | |
| 6,841,038 | B2 | 1/2005 | Horenziak et al. | |
| 6,911,114 | B2 | 6/2005 | Lindsay et al. | |
| 7,048,826 | B2 | 5/2006 | Archer et al. | |
| 7,404,875 | B2 | 7/2008 | Clungeon et al. | |
| 7,744,722 | B1 | 6/2010 | Tucker et al. | |
| 7,807,023 | B2 * | 10/2010 | Dyer et al. | 162/168.1 |
| 7,879,188 | B2 * | 2/2011 | Dyer et al. | 162/168.1 |
| 8,147,649 | B1 * | 4/2012 | Tucker et al. | 162/112 |
| 2002/0148584 | A1 | 10/2002 | Edwards et al. | |
| 2004/0060675 | A1 | 4/2004 | Archer et al. | |
| 2004/0116885 | A1 | 6/2004 | Soerens et al. | |
| 2004/0127614 | A1 | 7/2004 | Jiang et al. | |
| 2004/0177940 | A1 | 9/2004 | Archer et al. | |
| 2004/0209058 | A1 | 10/2004 | Chou et al. | |
| 2004/0211534 | A1 | 10/2004 | Clungeon et al. | |
| 2005/0006040 | A1 | 1/2005 | Boettcher et al. | |
| 2005/0092450 | A1 | 5/2005 | Hill, Jr. | |
| 2005/0245669 | A1 | 11/2005 | Clungeon et al. | |
| 2006/0272787 | A1 | 12/2006 | Furman et al. | |
| 2007/0054986 | A1 | 3/2007 | Nguyen | |
| 2007/0137808 | A1 | 6/2007 | Lostocco et al. | |
| 2007/0204966 | A1 | 9/2007 | Chou et al. | |
| 2007/0246180 | A1 | 10/2007 | Liu | |
| 2008/0041543 | A1 * | 2/2008 | Dyer et al. | 162/111 |

FOREIGN PATENT DOCUMENTS

| | | |
|---|---|---|
| CA | 979579 | 12/1975 |
| EP | 0 743 172 | 8/1999 |
| EP | 1 013 825 | 6/2000 |

(Continued)

OTHER PUBLICATIONS

Furman, Gary S., "Adhesive Testing of Chemical Additives Applied to Yankee Dryers", 1990 Nonwovens Conference, page pp. 271-276, in 6 pages.

(Continued)

*Primary Examiner* — Jose A Fortuna
(74) *Attorney, Agent, or Firm* — Knobbe Martens Olson & Bear, LLP

(57) ABSTRACT

A creping aid system for use on a creping cylinder, for example, a Yankee dryer, comprises a creping adhesive and a creping modifier, the combination comprising polyethylene.

17 Claims, 2 Drawing Sheets

(56) References Cited

FOREIGN PATENT DOCUMENTS

| | | |
|---|---|---|
| EP | 0 809 734 | 3/2003 |
| EP | 1 353 010 | 10/2003 |
| JP | 61250081 | 11/1986 |
| JP | 7207597 | 8/1995 |
| JP | 2003061886 | 3/2003 |
| JP | 2003103740 | 4/2003 |
| WO | WO 01/38636 | 5/2001 |
| WO | WO 03/000491 | 1/2003 |
| WO | WO 2004/031475 | 4/2004 |
| WO | WO 2004/079076 | 9/2004 |
| WO | WO 2004/099498 | 11/2004 |
| WO | WO 2005/060932 | 7/2005 |
| WO | WO 2005/108442 | 11/2005 |
| WO | WO 2008068652 A2 * | 6/2008 |

OTHER PUBLICATIONS

Micropump, Inc., "Paper Making—Creping & Release Aids", date unknown, but prior to Jun. 2006.

Online catalogue for Hercules, "Crepetrol Creping and Rezosol Release Technologies," at www.ppd.herc.com visited on Nov. 8, 2005.

Sloan, James H., "Yankee dryer coatings," Yankee Coatings, Aug. 1991 Tappi Journal, in 4 pages.

Polyethylene oxide—PubChem Public Chemical Database, Polyethylene oxide—Substance Summary from website: http:/pubchem.ncbi.nlm.nih.gov/summary/summary.cgi?sid=47208080&loc=es_rss.com, in 6 pages, accessed Jan. 6, 2011.

Ethylene Glycol—PubChem Public Chemical Database, Ethylene Glycol—Compound Survey from website: http:/pubchem.ncbi.nlm.nih.gov/summary/summary.cgi?sid=47208080 &viewopt=PubChem&ncount=40.com, in 7 pages, accessed Jan. 6, 2011.

Oxidized polyethylene—PubChem Public Chemical Database, Oxidized polyethylene—Substance Summary from website: http:/pubchem.ncbi.nlm.nih.gov/summary/summary.cgi?sid=50065654 &loc=es_rss.com, in 1 page, accessed Jan. 6, 2011.

Oxidized polyethylene—PubChem Public Chemical Database, Oxidized polyethylene—Compound Summary from website: http:/pubchem.ncbi.nlm.nih.gov/summary/summary.cgi?sid=24847855.com, in 2 pages, accessed Jan. 6, 2011.

Ash, Michael and Irene, "Handbook of Green Chemicals", Second Edition, Synapse Information Resources, Inc. 2004, Cover, Title page, and p. 7, in 3 pages.

"Honeywell A-C 629, 629A Oxidized Polyethylene Homopolymer", Honeywell International Inc. 2008 in 1 page.

* cited by examiner

CREPING ADHESIVE MODIFIER AND METHODS FOR PRODUCING PAPER PRODUCTS

RELATED APPLICATIONS

This application is a continuation of U.S. patent application Ser. No. 12/825,079, filed Jun. 28, 2010, now U.S. Pat. No. 8,147,649, which is a continuation of U.S. patent application Ser. No. 11/454,360, filed Jun. 15, 2006, now U.S. Pat. No. 7,744,722, the contents of each of which are hereby incorporated by reference herein in their entirety.

BACKGROUND OF THE INVENTION

1. Field of the Invention

The present application relates to the use of modifiers for a creping adhesive used in the production of creped paper.

2. Description of the Related Art

Softness of a paper product, such as a tissue or towel, is a desirable attribute. Softness, like strength and absorbency, plays a key role in consumer preference. Softness relates both to the product bulk and surface characteristics. Softness is the tactile sensation perceived by a user when they touch and hold the paper product.

Paper is generally manufactured by suspending cellulosic fibers of appropriate length in an aqueous medium and then removing most of the water from the resulting web. The paper derives some of its structural integrity from the mechanical arrangement of the cellulosic fibers in the web, but most of the paper's strength is derived from hydrogen bonding, which links the cellulosic fibers to one another. The strength imparted by this interfiber bonding, while necessary to the utility of the product, results in a lack of perceived softness that is inimical to consumer acceptance.

One method of increasing the softness of paper is by creping it. Creping, by breaking a significant number of interfiber bonds, increases the perceived softness of the resulting product. Creping processes are well known in the art. The fibrous structure of the paper is mechanically foreshortened in the machine direction in order to enhance bulk, stretch, and softness. The fibrous web is adhered to a dryer, for example, a Yankee dryer, and removed from the dryer using a flexible creping blade. The terms "creping blade," "crepe blade," and "doctor blade" are used interchangeably herein. The creping blade can be made of metal, ceramic, or other materials known in the art. The degree to which the web is adhered to the dryer is a factor in determining how uniform the creping will be, and thus, the bulk, stretch, and softness of the creped web.

Creping aids are applied to a creping dryer surface to facilitate the creping process. Creping aids can comprise creping adhesives, creping modifiers, other creping additives, and/or combinations thereof. The adhesion level of the web to the dryer surface is important, since it relates to the controllability of the web from the creping blade to the reel on which the paper is wound. Paper webs not sufficiently adhered to a creping dryer surface are difficult to control and can cause wrinkles and weaving of the web in the parent roll. When a web weaves at the reel, the parent roll edges are uneven. Poorly creped webs not only affect the reliability of the papermaking operation, but also can cause sheet breaks and difficulties in converting base sheet into finished product rolls of towel or tissue.

The level of adhesion of a web to a creping dryer surface is also important because it relates to the transfer of heat from the surface of the dryer to the web and ultimately affects the drying rate. Therefore, higher levels of adhesion allow for a web to dry faster, thus allowing the paper machine to operate at higher speeds.

A through-air-dried web tends to have poorer adhesion to a creping dryer surface than a conventionally wet pressed web. There are several reasons for this phenomenon. First, through-air-dried webs contact the surface of a creping dryer at lower contact levels since the web is transferred to the surface of the creping dryer with a limited-knuckle-area fabric, while a conventionally wet-pressed web is pressed more uniformly with a felt against the dryer surface. Second, through-air-dried webs are transferred to a creping dryer surface at higher dryness levels, while conventionally wet-pressed webs are transferred at lower dryness levels. The lower dryness level facilitates more intimate contact of the web with the dryer surface and, hence, better adhesion.

It is important that the creping aids have the proper softness/flexibility to allow sheet adhesion yet allow a doctor blade to maintain a clean creping dryer surface. For example, if a creping adhesive becomes too hard, incomplete removal of adhesive from the creping surface can occur and portions of the web may remain adhered to the creping dryer surface. When portions of the web remain adhered to the creping dryer, defects often result in the web, ultimately leading to poor quality products and breaks in the web in the open draw between the creping doctor and reel.

Excessive build-up of creping adhesive on the creping dryer surface is another problem associated with the use of creping aids, for example, producing streaky dryers. The streaks on the dryer impact the profile of adhesion in the cross-direction (CD), or width direction, of a paper machine, often resulting in reels with bumps or wrinkles. The usual remedy is to change creping blades; however, changing the blades leads to downtime of the paper machine, and creping blades are costly. Alternatively, coating streaks can be controlled through the use of a cleaning blade, which is positioned after the creping blade on a creping dryer. The cleaning blade is frequently changed to control streaks and excessive adhesive build-up.

SUMMARY OF THE INVENTION

In order to prevent adhesive build-up, creping aid systems need to provide proper levels of tack, yet be soft enough to be removed by the creping blade. Disclosed is a creping aid system that provides the proper levels of tack, yet is soft enough to be removed by the creping blade. As a result, the creping aid system provides for an improved creping process. Furthermore, some embodiments of a creping modifier provide an improved, more uniform creped paper product. According to some embodiments, the creping modifier comprises polyethylene. Embodiments of creping modifiers comprising polyethylene can beneficially affect the adhesive characteristics of a creping adhesive and thus, beneficially affect the structure of the final creped web and the paper making process.

In some embodiments, an improved creping aid system can remain softer and tackier through the use of a creping modifier comprising polyethylene.

Some embodiments provide a method for creping a fibrous web comprising: applying a creping adhesive to a surface of a creping cylinder; applying a creping modifier comprising polyethylene to the surface of the creping cylinder; and pressing a fibrous web against the surface of the creping cylinder, thereby causing sheet transfer and adhesion of the fibrous web to the surface of the creping cylinder. Some embodiments further comprise forming a fibrous web. Some embodiments further comprise removing the fibrous web from the surface of the creping cylinder using a doctor blade.

In some embodiments, a creping adhesive and creping modifier are mixed before applying to the surface of the creping cylinder. In some embodiments, the creping adhesive and creping modifier are applied separately to the surface of the creping cylinder. In some embodiments, at least one of the creping modifier or creping adhesive is first applied to the fibrous web, and the at least one of the creping modifier or creping adhesive is transferred to the surface of the creping cylinder on pressing the fibrous web against the surface of the creping cylinder.

In some embodiments, the creping adhesive further comprises at least one of a thermosetting resin, a non-thermosetting resin, a polyamide resin, a polyaminamide resin, a glyoxylated polyacrylamide resin, a film-forming semi-crystalline polymer, hemicellulose, carboxymethyl cellulose, polyvinyl alcohol, or an inorganic cross-linking agent. In some embodiments, the polyethylene has a drop point of not greater than about 150° C. In some embodiments, the creping modifier further comprises at least one of a release agent, an emulsifier, mineral oil, a surfactant, a cationic surfactant, or a nonionic surfactant. In some embodiments, the creping adhesive and creping modifier together form a creping aid system, and the polyethylene comprises from about 0.1% to about 50% of the total solids of the creping aid system by weight.

In some embodiments, the doctor blade life is increased by at least about 25% compared with a similar process not using a creping modifier comprising polyethylene.

Some embodiments provide a creping modifier comprising: a fluid; and from about 0.1% to about 70% by weight of polyethylene. In some embodiments, the fluid comprises from about 40% to about 99% by weight water and the polyethylene is emulsified in the fluid. Some embodiments further comprise a release agent and at least one surfactant.

In some embodiments, the creping modifier comprises: from about 0.1% to about 80% by weight solids polyethylene; from about 0% to about 60% by weight solids mineral oil; up to about 10% by weight solids cationic surfactant; and up to about 40% by weight solids nonionic surfactant.

In some embodiments, the creping modifier comprises: from about 5% to about 70% by weight solids polyethylene; from about 10% to about 60% by weight solids mineral oil; up to about 5% by weight solids cationic surfactant; and up to about 30% by weight solids nonionic surfactant.

In some embodiments, the creping modifier comprises: from about 40% to about 90% by weight water; from about 1% to about 50% by weight polyethylene; from about 5% to about 30% by weight mineral oil; up to about 2% by weight cationic surfactant; and up to about 5% by weight nonionic surfactant.

In some embodiments, the creping modifier comprises: from about 50% to about 80% by weight water; from about 5% to about 30% by weight polyethylene; from about 10% to about 20% by weight mineral oil; up to about 1% cationic surfactant; and up to about 3% nonionic surfactant.

Some embodiments provide a creping aid system comprising a creping adhesive and the creping modifier comprising water; and from about 0.1% to about 70% by weight of polyethylene. In some embodiments, the polyethylene comprise from about 1% to about 50% of the total solids of the creping aid system by weight.

Some embodiments provide a creped paper product manufactured according to a method comprising: applying a creping adhesive to a surface of a creping cylinder; applying a creping modifier comprising polyethylene to the surface of the creping cylinder; and pressing a fibrous web against the surface of the creping cylinder, thereby causing sheet transfer and adhesion of the fibrous web to the surface of the creping cylinder.

Some embodiments provide a method for creping a fibrous web comprising: applying a creping adhesive to a surface of a creping cylinder; applying a means for reducing creping adhesive build-up to the surface of a creping cylinder; pressing a fibrous web against the surface of the creping cylinder, thereby causing sheet transfer and adhesion of the fibrous web to the surface of the creping cylinder; and removing the fibrous web from the surface of the creping cylinder using a doctor blade.

DETAILED DESCRIPTION OF SOME PREFERRED EMBODIMENTS

Some embodiments described herein provide improved absorbent paper web properties and/or paper machine runnability through the use of a creping modifier. Examples of absorbent paper web as defined herein include bath tissue, paper towels, paper napkins, wipers, facial tissue, and the like. In some embodiments, the basis weight of such products and their base sheets are in the range of about 8 lb/3000 $ft^2$ to about 50 lb/3000 $ft^2$.

A creping aid system preferably comprises one or more creping aids that can be applied to a dryer to facilitate adhering and removing paper from a dryer during a paper manufacturing process. According to some embodiments described in more detail below, a creping aid system comprises a creping adhesive and a creping modifier. In one embodiment, the creping adhesive comprises a thermosetting or non-thermosetting resin and the creping modifier comprises polyethylene. A creping modifier comprising polyethylene provides a number of advantages, for example, combinations of longer blade life, reduced maintenance and expense associated with cleaning the dryer and replacing blades, and a more uniform coating compared with creping modifiers without polyethylene. These and other advantages will be described in more detail below.

Paper Making Machines and Processes

Figure 1:
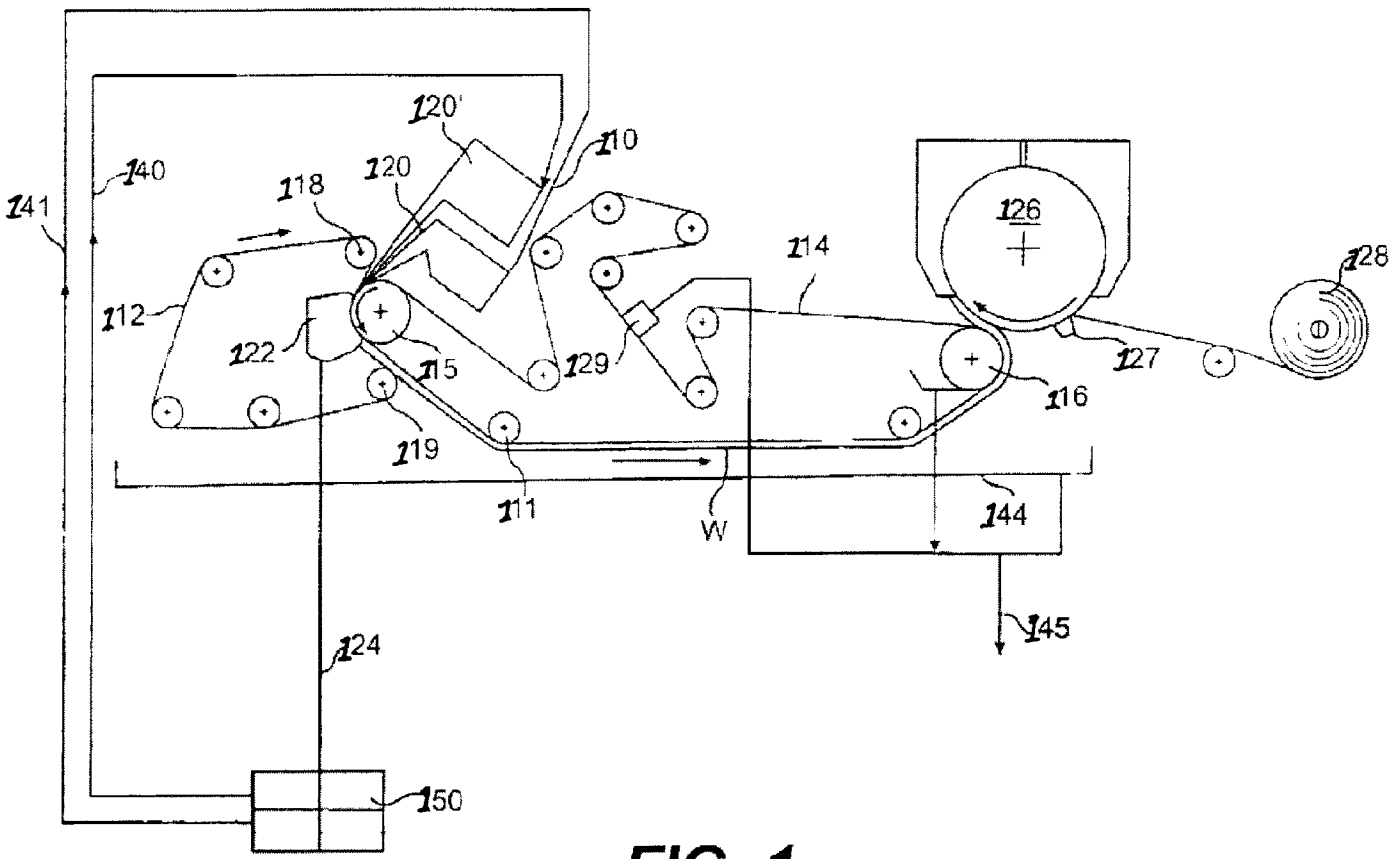
FIG. 1 is a schematic illustration of an embodiment of a wet press process machine.

In some preferred embodiments, absorbent paper is produced using any known method of drying. The most common drying methods include (I) conventional wet pressing (CWP) and (II) through-air-drying (TAD). In a typical wet press process and apparatus 110, as exemplified in FIG. 1, a furnish is fed from a stuffbox not shown into conduits 140 and 141 to headbox chambers 120 and 120'. A web W is formed on a wire former 112, supported by rolls 118 and 119, from liquid slurry of pulp, water and other chemicals. Materials removed from the web through fabric 112 in the forming zone are returned to silo 150, from saveall 122 through conduit 124. The web is then transferred to a moving felt or fabric 114, supported by roll 111 for drying and pressing. Materials removed from the web during pressing or from the Uhle box 129 are collected in saveall 144 and fed to white water conduit 145. The web is then pressed by suction press roll 116 against the surface of a rotating Yankee dryer cylinder 126, which is heated to cause the paper to substantially dry on the cylinder surface. Although not shown in FIG. 1, in some embodiments a shoe press is used in place of the suction press roll to press the paper against the surface of a rotating Yankee dryer cylinder 126. The moisture within the web as it is laid on the Yankee surface causes the web to transfer to the surface. Sheet dryness levels immediately after the suction press roll are in the range of about 30% to about 50% dryness. One or more creping aids of a creping aid system, including, for example, a creping adhesive, a creping modifier, other creping additives, and/or combinations thereof, are applied to the surface of the dryer to provide substantial adhesion of the web to the creping surface. In some embodiments, one or more creping aids of the creping aid system comprise a liquid. The web is then creped from the surface with a creping blade 127 or a roller equipped with a fabric. Details of roll creping are generally described in U.S. Pat. Nos. 5,223,092 and 5,314,584, which are incorporated herein by reference. The creped web is then optionally passed between calender rollers (not shown) and rolled up on roll 128 prior to further converting operations, for example, embossing.

In some alternative embodiments, a web is subjected to vacuum deformation on an impression fabric, alone or in conjunction with other physical deformation processes, and a drying step, which dries the web to a solids content of at least about 30% without the need for overall physical compression. This type of process is typically referred to as a through-air-drying process or TAD process. This process is generally described in U.S. Pat. Nos. 3,301,746, to Sanford et al. and 3,905,863, to Ayers, which are incorporated herein by reference.

Figure 2:
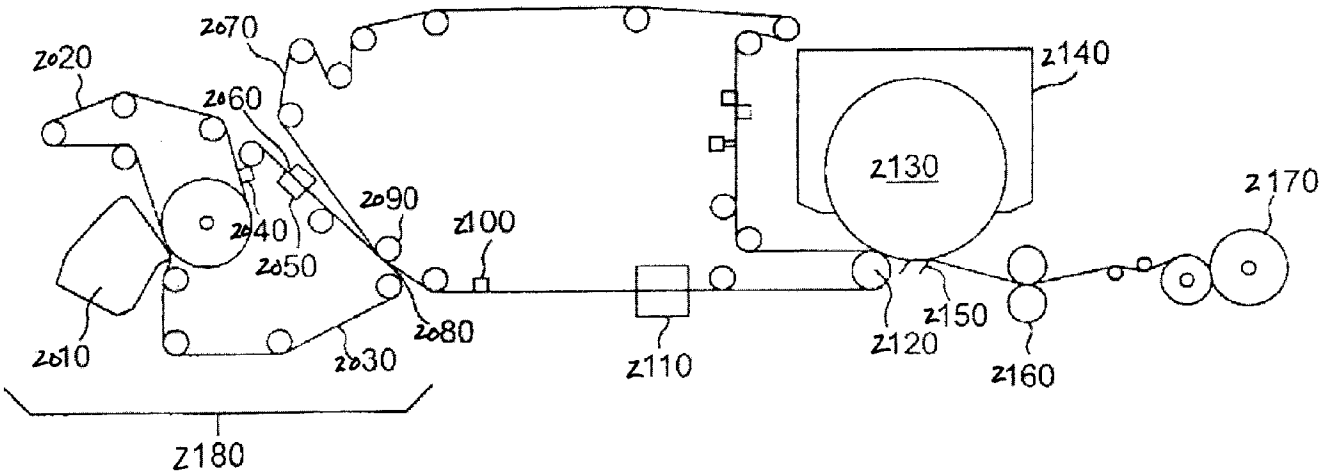
FIG. 2 is a schematic illustration of an embodiment of a through-air-drying process machine.

As an example, a typical TAD process with reference to the apparatus 2000 is illustrated in FIG. 2. In this process, fibers are fed from a headbox 2010 to a converging set of forming wires 2020 and 2030. In the illustrated twin wire forming arrangement water is removed from the web by centrifugal forces and by vacuum means. The wet nascent web is cleanly transferred to forming wire 2030 via Uhle box 2040. The web can be optionally processed to remove water by vacuum box 2050 and steam shroud 2060. The web is carried along forming fabric 2030 until it is transferred to a TAD fabric 2070 at junction 2080 by means of a vacuum pickup shoe 2090. The web is further dewatered at dewatering box 2100 to increase web solids. Besides removing water from the web, vacuum pickup shoe 2090 and dewatering box 2100 inundate the web into the TAD fabric 2070 causing bulk and absorbency characteristics.

In some embodiments, further enhancements in bulk and absorbency are obtained by operating the speed of the forming section (e.g., the speeds of forming wires 2020 and 2030) faster than the speed of TAD fabric 2070. This process is referred to as "fabric creping." Fabric creping is defined mathematically as the difference in speed between the forming wires 2020 and 2030 and the through-air-dryer fabric 2070 divided by the speed of the through-air-dryer fabric 2070 expressed as a percentage. In this manner, the web is inundated and wet shaped into the fabric creating bulk and absorbency. The amount of fabric crepe is from 0% to about 25% in some embodiments. Thickness created by wet shaping is often more effective in generating absorbency (e.g., having less structural collapse) than thickness created in the dry state, for example, by conventional embossing.

The web is then carried on the TAD fabric 2070 to a drying unit 2110 where heated air is passed through both the web and the fabric to increase the solids content of the web. Generally, the web is from about 30% to about 95% dry after exiting drying unit 2110. In one process, the web is removed directly from the TAD fabric 2070 in an uncreped process. In the embodiment shown in FIG. 2, the web is transferred from the TAD fabric 2070 to Yankee dryer cylinder 2130 and is creped from the dryer cylinder 2130 via creping blade 2150, thus producing a creped product.

With reference to FIG. 2, the creping aid system is applied to the Yankee dryer cylinder 2130 surface to provide substantial adhesion of the web to the creping surface. The web is then creped from the surface 2130 with a creping blade 2150. The creped web is then optionally passed between calender rollers 2160 and rolled up on roll 2170 prior to further converting operations, for example, embossing. The Speed of the reel 2170 is faster or slower than the speed of the Yankee dryer 2140. The level of creping is defined as the speed difference between the Yankee dryer 2140 and the reel 2170 divided by the Yankee dryer 2140 speed expressed as a percentage. The action of the creping blade 2150 on the paper is known to cause a portion of the interfiber bonds within the paper to be broken up by the mechanical smashing action of the blade 2150 against the web as it is being driven into the blade 2150. However, it is believed that fairly strong interfiber bonds are formed between wood pulp fibers during the drying of moisture from the web.

In some embodiments, an absorbent paper web is made by dispersing fibers into aqueous slurry and depositing the aqueous slurry onto the forming wire of a papermaking machine, using any art recognized forming scheme. For example, an extensive, but non-exhaustive, list includes a crescent former, a C-wrap twin-wire former, an S-wrap twin wire former, a suction breast roll former, a fourdrinier former, or any other art recognized forming configuration. In some embodiments, the web is homogenously formed or stratified. When homogenously forming a web, the stock in the various headbox chambers is uniform. When forming a web by stratification, the stock in the various headbox chambers is not uniform. The forming fabric or wire is any art recognized foraminous member, including single layer fabrics, double layer fabrics, triple layer fabrics, photopolymer fabrics, and the like.

Fibers

The papermaking fibers used to form the web preferably include cellulosic fibers commonly referred to as wood pulp fibers, liberated in a chemical or mechanical pulping process from softwood (gymnosperms or coniferous trees) and/or hardwoods (angiosperms or deciduous trees). Any suitable tree and pulping process can be used to liberate the tracheid.

Cellulosic fibers from diverse material origins are useful in forming the web, including non-woody fibers liberated from, for example, sabai grass, wheat straw, kenaf, hemp, linen, bagasse, rice straw, banana leaves, paper mulberry (i.e., bast fiber), abaca leaves, pineapple leaves, esparto grass leaves, and fibers from the genus *Hesperalae* in the family Agavaceae. Recycled fibers and refined fibers, which may contain any of the above fiber sources in different percentages are also useful. Other natural and synthetic fibers such as cotton fibers, wool fibers, bi-component fibers, and combinations are also useful.

In some embodiments, papermaking fibers are liberated from their source material by any one of the number of chemical pulping processes familiar to the skilled artisan including sulfate, sulfite, polysulfite, soda pulping, combinations, and the like. Furthermore, in some embodiments, papermaking fibers are liberated from source material by any one of a number of mechanical/chemical pulping processes familiar to anyone experienced in the art including mechanical pulping, thermo-mechanical pulping, and chemi-thermo-mechanical pulping. The pulp is bleached in some embodiments by chemical means known in the art, for example, chlorine, chlorine dioxide, oxygen, combinations thereof, and the like. Other bleaching methods include alkaline peroxide and ozone bleaching.

Fiber Treating Agents

In some embodiments, the slurry of fibers contains additional treating agents and/or additives that alter the physical properties of the paper. These agents and/or additives are well understood by the skilled artisan and can be used in any known combination. Because strength and softness are particularly important properties for paper napkins, bath tissue, paper towels, and the like, in some embodiments, the pulp is mixed with strength adjusting agents, such as wet strength agents, temporary wet strength agents, dry strength agents, debonders/softeners, combinations thereof, and the like.

Suitable wet strength agents will be readily apparent to the skilled artisan. A comprehensive but non-exhaustive list of useful wet strength aids include aliphatic and aromatic aldehydes, urea-formaldehyde resins, melamine formaldehyde resins, polyamide-epichlorohydrin resins, and the like. According to some embodiments, the pulp contains up to about 30 lb/ton of wet strength agent. According to other embodiments, the pulp contains from about 20 to about 30 lb/ton of a wet strength agent.

Suitable temporary wet strength agents are readily apparent to the skilled artisan. A comprehensive but non-exhaustive list of useful temporary wet strength agents includes aliphatic and/or aromatic aldehydes including glyoxal, malonic dialdehyde, succinic dialdehyde, glutaraldehyde, and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which in some embodiments are reacted with the aldehyde containing monomers and/or polymers, include vinylamides, acrylamides, and related nitrogen containing polymers. In some embodiments, these polymers impart a positive charge to the aldehyde containing reaction product. Combinations of these temporary wet strengths agents are used in some embodiments. According to one embodiment, the pulp contains up to about 30 lb/ton of a temporary wet strength agent. According to another embodiment, the pulp contains from 0 to about 10 lb/ton of a temporary wet strength agent.

Suitable dry strength agents will be readily apparent to one skilled in the art. A comprehensive but non-exhaustive list of useful dry strength agents includes starch, guar gum, polyacrylamides, carboxymethyl cellulose, combinations thereof, and the like. According to one embodiment, the pulp contains from 0 lb/ton to about 15 lb/ton of dry strength agent. According to another embodiment, the pulp contains from about 1 lb/ton to about 5 lb/ton of dry strength agent.

Suitable debonders and softeners will also be readily apparent to the skilled artisan. These debonders and softeners may be incorporated into the pulp or sprayed upon the web after its formation. According to one embodiment of the invention, softening and debonding agents are added in an amount of not greater than about 2%, by weight. According to another embodiment, softening and debonding agents are added in an amount not greater than about 1%. According to yet another embodiment, the softening and debonding agents are added in an amount between 0% and about 0.4%, by weight.

Suitable additives, such as particulate fillers will be readily apparent to one skilled in the art. A comprehensive, but non-exhaustive, list of useful additives, such as particulate fillers includes clay, calcium carbonate, titanium dioxide, talc, aluminum silicate, calcium silicate, calcium sulfate, combinations thereof, and the like.

Suitable retention aids will be readily apparent to one skilled in the art. A comprehensive, but non-exhaustive, list of useful retention aids includes anionic and cationic flocculants, and combinations thereof.

Alternatively, instead of being incorporated into the pulp, these treating agents are applied to the web in some embodiments, which is accomplished through one or more applicator systems that apply the treating agents to either one or both surfaces of the web. Application of multiple treating agents using multiple application systems helps to prevent chemical interaction of treating materials prior to their application to the cellulose web. Alternative configurations and application positions will be readily apparent to the skilled artisan.

Other additives present in the fibrous slurry used in some embodiments include sizing agents, absorbency aids, opacifiers, brighteners, optical whiteners, barrier chemistries, lotions, dyes, colorants, combinations, and the like.

Fibrous Web Processing

After deposition of the fibrous slurry onto the forming wire, the thus-formed wet fibrous web is transferred onto a dewatering felt or an impression fabric, which is used to create a pattern in the web, if desired. Any art-recognized fabrics or felts are useful.

Drying

After transfer, the web, at some point, is passed through the dryer section, thereby substantially drying the web. As described above, in preferred embodiments, the web is dried using conventional wet-pressing techniques, or using through-air-drying (TAD). If produced using TAD, the web is pressed to the surface of a rotating Yankee dryer cylinder to remove additional moisture within the web in some embodiments. Other suitable processes include wet creping or through-air-drying with wet creping. The creping blade is any type of creping blade known in the art, including, but not limited to, steel blades, ceramic blades, and biaxially undulatory blades.

Creping Aids

A creping aid system preferably comprises one or more creping aids. According to some embodiments, a creping aid system comprises a creping adhesive. In some embodiments, a creping aid system comprises a creping modifier. In some embodiments, a creping aid system comprises other creping additives. In some embodiments, a creping aid system comprises combinations of creping aids to be applied together. In some embodiments, a creping aid system comprises combinations of creping aids, at least one of which is applied separately.

Creping Adhesives

In some embodiments, a creping adhesive comprises a thermosetting or non-thermosetting resin, a film-forming semi-crystalline polymer, and/or an inorganic cross-linking agent. In some embodiments, a creping adhesive includes any art-recognized components, including, but not limited to, organic cross-linkers, hydrocarbons oils, surfactants plasticizers, and combinations thereof.

Suitable creping adhesives include any art-recognized thermosetting and/or non-thermosetting resin. Resins according to one embodiment are chosen from thermosetting and/or non-thermosetting polyamide resins, and/or glyoxylated polyacrylamide resins. Polyamides comprise branched and/or unbranched, saturated and/or unsaturated portions.

Some embodiments use polyamide resins, including polyaminamide-epichlorohydrin (PAE) resins. Suitable PAE resins include, water-soluble polymeric reaction products of an epihalohydrin, preferably epichlorohydrin resins included with water-soluble polyaminamides having secondary amine groups derived from a polyalkylene polyamine and a saturated aliphatic dibasic carboxylic acid containing from about 3 to about 10 carbon atoms.

In some embodiments, a polyaminamide resin has a viscosity of from about 80 centipoise to about 800 centipoise and a total solids of from about 5% to about 40%. According to one embodiment, the polyaminamide resin is present in the creping adhesive in an amount of from about 0% to about 99.5%. According to another embodiment, the polyaminamide resin is present in the creping adhesive in an amount of from about 40% to about 98%. In yet another embodiment, the polyaminamide resin is present in the creping adhesive in an amount of from about 60% to about 95% based on the total solids of the creping adhesive composition.

Examples of suitable polyaminamide resins are commercially available from Clearwater Specialties LLC, (Clarkston, Washington), include, but are not limited to, CS-112, CS-120, CS-121, and CS-124. Some embodiments of the creping adhesive comprise a combination of PAE resins.

Some embodiments of the creping adhesive comprise a film-forming semi-crystalline polymer. Suitable film-forming semi-crystalline polymers are known in the art, for example, hemicellulose, carboxymethyl cellulose, and/or polyvinyl alcohol (PVOH). In some embodiments, the polyvinyl alcohols have an average molecular weight of from about 13,000 to about 124,000 Daltons. According to one embodiment, polyvinyl alcohols have a degree of hydrolysis of from about 80% to about 99.9%. According to another embodiment, polyvinyl alcohols have a degree of hydrolysis of from about 85% to about 95%. In yet another embodiment, polyvinyl alcohols have a degree of hydrolysis of from about 86% to about 90%. According to one embodiment, polyvinyl alcohols have a viscosity, measured at 20° C. using a 4% aqueous solution, of from about 2 centipoise to about 100 centipoise. According to another embodiment, polyvinyl alcohols have a viscosity of from about 10 centipoise to about 70 centipoise. In yet another embodiment, polyvinyl alcohols have a viscosity of from about 20 centipoise to about 50 centipoise.

According to one embodiment, the polyvinyl alcohol is present in the creping adhesive in an amount of from about 0% to about 99.5% by weight, based on the total solids of the creping adhesive composition. According to another embodiment, the polyvinyl alcohol is present in the creping adhesive in an amount of from about 20% to about 80% by weight. In yet another embodiment, the polyvinyl alcohol is present in the creping adhesive in an amount of from about 40% to about 60%, by weight.

Some embodiments of the creping adhesive comprise one or more inorganic cross-linking salts or agents known in the art, for example, comprising one or more multivalent metal ions and suitable anions. A non-exhaustive list of multivalent metal ions includes calcium, barium, titanium, chromium, manganese, iron, cobalt, nickel, zinc, molybdenum, tin, antimony, niobium, vanadium, tungsten, selenium, and zirconium. Mixtures of metal ions can be used. Suitable anions include, but are not limited to, acetate, formate, hydroxide, carbonate, chloride, bromide, iodide, sulfate, tartrate, and phosphate mixtures of anions are also useful. According to one embodiment, the inorganic cross-linking salt comprises a zirconium salt. The zirconium salt according to one embodiment is one or more zirconium compounds having a +4 valence, such as ammonium zirconium carbonate, zirconium acetylacetonate, zirconium acetate, zirconium carbonate, zirconium sulfate, zirconium phosphate, potassium zirconium carbonate, zirconium sodium phosphate, sodium zirconium tartrate, and the like.

According to one embodiment, the inorganic cross-linking salt is present in the creping adhesive in an amount of from about 0% to about 30%. In another embodiment, the inorganic cross-linking agent is present in the creping adhesive in an amount of from about 1% to about 20%. In yet another embodiment, the inorganic cross-linking salt is present in the creping adhesive in an amount of from about 1% to about 10% by weight based on the total solids of the creping adhesive composition.

Optionally, the creping adhesive includes any other art recognized components, including, but not limited to, organic hydrocarbon oils, surfactants, humectants, plasticizers, and/or other surface treatment agents. An extensive, but non-exhaustive, list of organic cross-linkers includes glyoxal, maleic anhydride, bismaleimide, bisacrylamide, epihalohydrin, and mixtures thereof. The organic cross-linkers comprise cyclic and/or non-cyclic compounds. Useful plasticizers include propylene glycol, diethylene glycol, triethylene glycol, dipropylene glycol, glycerol and mixtures thereof.

Creping Modifiers

Embodiments of a creping modifier preferably comprise at least one suitable polymer that improves the creping process as described in greater detail below, by, for example, reducing build-up of creping adhesive, and/or extending the life of the doctor blade. In some embodiments, the polymer comprises polyethylene, polypropylene, polyethylene copolymers, ethylene vinyl acetate, ethylene propylene, combinations, mixtures, and/or blends thereof, and the like. Other suitable polymers include halogenated polymers and copolymers, for example, polytetrafluoroethyelene, polyvinylidene fluoride, and the like. In some embodiments, the polymer has a drop point of not greater than about 150° C. Some preferred embodiments comprise at least one of the polymers in any suitable fluid known in the art, for example, air, nitrogen, water, oil, mineral oil, vegetable oil, refined petroleum, alcohols, combinations and the like. Some preferred embodiments comprise the polymer in an emulsion, for example, in an aqueous medium. As such, some preferred embodiments further comprise one or more suitable emulsifying agents known in the art, for example, non-ionic surfactants, ionic surfactants, anionic surfactants, cationic surfactants, combinations thereof, and the like. In some embodiments, at least one polymer is not emulsified, for example, provided as a suspension, an aerosol, a melt, and/or otherwise fluidized. Embodiments of creping modifiers, creping aid systems, and creping methods are described with reference polyethylene as the polymer. Those skilled in the art will understand that other polymer(s) discussed herein are also useful as the polymer in other embodiments.

In some preferred embodiments, a creping modifier comprises polyethylene. In some embodiments, a creping modifier comprises between about 0.1% and about 70% polyethylene by weight. In some embodiments, a creping modifier comprises between about 0.1% and about 50% polyethylene by weight. In some embodiments, a creping modifier comprises between about 5% and about 30% polyethylene by weight. In some embodiments, a creping modifier comprises between about 10% and about 25% polyethylene by weight. In some embodiments, a creping modifier comprises between about 18% and about 20% polyethylene by weight.

In one embodiment, a creping modifier comprises about 45 wt % polyethylene emulsion (including about 45 wt % polyethylene solids and about 55 wt % water in some embodiments), about 38% water, about 15% release agent, and about 2% emulsifier by weight. In some embodiments, water from the polyethylene emulsion in addition to other water in the creping modifier preferably comprises between about 40 wt % and about 99 wt % total water in the creping modifier. In some embodiments, the polyethylene emulsion comprises about 45 wt % polyethylene solids and at least one nonionic surfactant. In some embodiments, the polyethylene emulsion functions as a release and/or modifier for an adhesive. In some embodiments, the release agent further comprises a combination of mineral oil and cationic surfactant. A preferred release agent in these embodiments is mineral oil. For example, in one embodiment, the creping modifier comprises about 14% 100SUS HVI mineral oil and about 1% Arosurf PA842 cationic surfactant, which function as release agents. In some embodiments, the emulsifier comprises one or more nonionic surfactants. For example, in one embodiment, the creping modifier comprises between about 1% and about 2% tall oil PEG ester nonionic surfactant and about 1% Tergitol TMN3 nonionic surfactant, which function as emulsifiers. An example of one suitable creping modifier is CS-329, commercially available from Clearwater Specialties LLC. Examples of suitable creping modifier compositions are provided in TABLE I, where percentages are by weight solids. These solids can be comprised in a fluid comprising between about 40 wt % and about 99 wt % water in some embodiments.

TABLE I

| Component | Range (wt % solids) | Preferred Range (wt % solids) |
|---|---|---|
| Polyethylene | about 0.1%-80% | about 5%-70% |
| Release agent | about 0%-60% | about 10%-60% |
| Cationic Surfactant | up to about 10% | up to about 5% |
| Nonionic Surfactant | up to about 40% | up to about 30% |

In some embodiments, the creping modifier comprises: from about 40% to about 90% by weight water; from about 1% to about 50% by weight polyethylene; from about 5% to about 30% by weight mineral oil; up to about 2% by weight cationic surfactant; and up to about 5% by weight nonionic surfactant.

In some embodiments, the creping modifier comprises: from about 50% to about 80% by weight water; from about 5% to about 30% by weight polyethylene; from about 10% to about 20% by weight mineral oil; up to about 1% cationic surfactant; and up to about 3% nonionic surfactant.

In some embodiments, the polyethylene melts when applied to the hot dryer. Those skilled in the art will understand that different types of polyethylene are suitable, depending on factors known in the art, for example, the dryer temperature, the dryer surface characteristics, the particular creping aid system, the characteristics of the fibrous web, the doctor blade(s), and the like. In some embodiments, the polyethylene has a drop point of not greater than about 150° C., preferably, not greater than about 130° C., more preferably from about 95° C. to about 105° C., most preferably about 100° C. In some embodiments, the acid value is from about 5 mg KOH/gm to about 50 mg KOH/gm, preferably from about 10 mg KOH/mg to about 40 mg KOH/gm, more preferably, from about 15 mg KOH/gm to about 25 mg KOH/gm. The polyethylene is linear or branched. In some embodiments, the polyethylene has a density of from about 0.90 g/cm$^3$ to about 1 g/cm$^3$. In some embodiments, the polyethylene is a low density, branched polyethylene. Mixtures are also suitable. Suitable commercially available polyethylenes include AC-629, which is an oxidized polyethylene, (drop point 101° C., acid value 14-16 mg KOH/g, density 0.93 g/cm$^3$, Honeywell), and Hoechst Wax 371 FP (drop point 98-103° C., acid value 17-25 mg KOH/g, density 0.95-0.97 g/cm$^3$; Clariant).

Creping Aid Systems

According to one embodiment, a creping aid system comprises from about 30% to about 99% creping adhesive and from about 1% to about 70% creping modifier comprising polyethylene, preferably, from about 40% to about 95% creping adhesive and about 5% to about 60% creping modifier, more preferably, from about 50% to about 80% creping adhesive and about 20% to about 50% creping modifier, for example, about 65% creping adhesive and about 35% creping modifier. According to some embodiments, a creping aid system comprises less than about 30% creping adhesive. According to some embodiments, a creping aid system comprises more than about 70% creping modifier comprising polyethylene. According to some embodiments, a creping aid system comprises more than about 90% creping adhesive. According to some embodiments, a creping aid system comprises less than about 10% creping modifier comprising polyethylene. According to some embodiments, a creping aid system comprises between about 0.1% and about 25% creping modifier comprising polyethylene, preferably between about 0.5% and about 15% creping modifier, for example, between about 1% to about 12% creping modifier.

According to one embodiment, a creping aid system comprises a creping adhesive, a creping modifier, and, optionally, other creping additives, where the creping modifier is present in the creping aid system in an amount of from about 0.1% to about 50% based on the total solids of the creping aid system composition. According to another embodiment, the creping modifier is present in the creping aid system in an amount of from about 0.5% to about 40% based on the total solids of the creping aid system composition. According to another embodiment, the creping modifier is present in the creping aid system in an amount of from about 1% to about 30% based on the total solids of the creping aid system composition. According to another embodiment, the creping modifier is present in the creping aid system in an amount of from about 5% to about 30% based on the total solids of the creping aid system composition. According to another embodiment, the creping modifier is present in the creping aid system in an amount of from about 10% to about 25% based on the total solids of the creping aid system composition. According to another embodiment, the creping modifier is present in the creping aid system in an amount of from about 15% to about 25% based on the total solids of the creping aid system composition. According to yet another embodiment, the creping modifier is present in the creping aid system in an amount of from about 18% to about 20% based on the total solids of the creping aid system composition.

According to one embodiment, a creping aid system comprises at least a creping adhesive and a creping modifier. In some embodiments, the creping modifier is present in the creping aid system in an amount of from about 0.1% to about 50% based on the total solids of the creping adhesive and the creping modifier. According to another embodiment, the creping modifier is present in the creping aid system in an amount of from about 0.5% to about 40% based on the total solids of the creping adhesive and the creping modifier. According to another embodiment, the creping modifier is present in the creping aid system in an amount of from about 1% to about 30% based on the total solids of the creping adhesive and the creping modifier. According to another embodiment, the creping modifier is present in the creping aid system in an amount of from about 5% to about 30% based on the total solids of the creping adhesive and the creping modifier. According to another embodiment, the creping modifier is present in the creping aid system in an amount of from about 10% to about 25% based on the total solids of the creping adhesive and the creping modifier. According to another embodiment, the creping modifier is present in the creping aid system in an amount of from about 15% to about 25% based on the total solids of the creping adhesive and the creping modifier. According to yet another embodiment, the creping modifier is present in the creping aid system in an amount of from about 18% to about 20% based on the total solids of the creping adhesive and the creping modifier.

In some embodiments, the polyethylene comprises from about 1% to about 50% of the total solids of the creping aid system by weight, more preferably, from about 5% to about 40%, more preferably, from about 10% to about 30%.

In some embodiments, the creping aid system is applied as a single composition. In some embodiments, the creping aid system is applied in any combination of its component parts. More particularly, in some embodiments, the creping adhesive is applied separately from the creping modifier. In some embodiments, the creping adhesive is applied together with the creping modifier. In some embodiments, a component of the creping adhesive is applied separately from another component of the creping adhesive. In some embodiments, a component of the creping modifier is applied separately from another component of the creping modifier. In one embodiment of a creping aid system, the creping adhesive and the creping modifier are applied as a single composition, allowing the creping modifier to more fully mix with the creping adhesive. In some embodiments, mixing one or more components of the creping modifier with one or more components of the creping adhesive can provide a more uniform modifying effect to enhance creping. In some embodiments, separately applying one or more components of the creping modifier and one or more components of the creping adhesive can provide enhanced creping.

According to one method, a fibrous web is formed as discussed above. A creping aid system is then applied to the surface of a creping cylinder, for example, on a Yankee dryer. As discussed above, the creping aid system comprises a creping adhesive, a creping modifier, and one or more optional additives. The fibrous web is pressed against the surface of the creping cylinder, which causes the fibrous web to adhere to the surface of the creping cylinder. The fibrous web is then removed from the creping cylinder using a doctor blade. In some embodiments, the creping aid system components are mixed before application to the creping cylinder. In some embodiments, at least one of the creping aid system components is applied to the fibrous web before it is pressed against the surface of the creping cylinder, after which, the component(s) are transferred from the web to the surface of the creping cylinder.

Example 1

Production of Tissue Paper

According to one test on a first machine, in a first setup ("Setup A"), a 0.05% solids aqueous solution of a creping aid system comprising a creping adhesive and a polyethylene creping modifier was sprayed on the surface of a Yankee dryer. The creping aid system comprised between about 89% and about 94% creping adhesive and between about 6% and about 11% polyethylene creping modifier by volume. The solids of the creping aid system, including the solids from both the creping adhesive and the creping modifier, comprised between about 63% and about 70% PAE Resin, between about 17% and about 19% plasticizer chemistry, between about 6% and about 11% polyethylene, and between about 5% and about 9% release agent. Thus, for example, between about 80% to 89% by weight of the solids come from the creping adhesive product comprising the PAE and/or plasticizers, and the remaining about 11% to 20% of the solids come from the polyethylene creping modifier comprising the polyethylene and/or other release agents. The ratios were balanced to produce good adhesion to the dryer surface yet still be able to release the sheet from the dryer. This application optimized the operation of the paper machine and the quality of the paper product produced on the first machine. A cellulosic fibrous web was pressed against the Yankee dryer surface and adhered to the drying surface. The dry web was removed from the drying surface with a doctor blade and was wound on a reel.

In a second setup ("Setup B"), a 0.05% solids aqueous solution of a creping aid system comprising a creping adhesive and a creping modifier without polyethylene was sprayed on the surface of a Yankee dryer. The creping aid system comprised about 45% to about 72% creping adhesive and about 28% to about 55% creping modifier without polyethylene. The solids of the creping aid system, including the solids from both the creping adhesive and the creping modifier, comprised between about 16% and about 18% PAE Resin, between about 4% and about 5% plasticizer chemistry, and between about 78% and about 80% release agent. Thus, for example, between about 20% to 23% by weight of the solids come from the creping adhesive product comprising the PAE and/or plasticizers. The ratios were balanced to produce good adhesion to the dryer surface yet still be able to release the sheet from the dryer. This application optimized the operation of the paper machine and the quality of the paper product produced on the first machine. A cellulosic fibrous web was pressed against the Yankee dryer surface and adhered to the drying surface. The dry web was removed from the drying surface with a doctor blade and was wound on a reel.

Setup A and Setup B exhibited a number of different characteristics. Setup A, which included the polyethylene creping modifier, had an increased doctor blade life. The doctor blade life is the amount of time the blade is able to stay in service on the machine without adversely affecting production. Over time the crepe blade begins to dull and as a result the caliper of the paper sheet increases. As the caliper of the paper increases to the upper range of acceptable limits, a new blade is inserted on the machine to reduce the caliper back into acceptable range. The rate of caliper increase over time is an indication of the wear rate of the crepe blade. The slower the rate of increase in caliper, the slower the wear rate of the blade. The slower rate of increase in caliper indicates that the creping aid system coating is providing a better wear surface to the blade, helping to keep it sharper longer. The average blade life using Setup B was approximately 8 hours. However, the average blade life using Setup A was approximately 14 hours. Using the polyethylene modifier of Setup A provided a longer blade life which allowed the machine to run at a higher efficiency by reducing the amount of waste paper that is produced during blade changes and improving the run time between blade changes.

The effort required to clean the dryer during blade changes showed that Setup A with the polyethylene modifier provided a much softer layer of adhesive on the dryer than Setup B. During blade changes, in order to return the dryer surface to a uniform condition across the width of the dryer, new blades are pressure loaded onto the dryer surface to remove old and excess adhesive. A creping coating that has become hard typically requires a higher loading pressure on the new blade to adequately clean the dryer. In fact, sometimes consecutive new blade (sharp blade) changes are required to adequately remove the old creping coating. A softer coating is typically easier to remove from the dryer, and therefore requires a lower loading pressure. In some cases, a softer coating eliminates the need to install a new cleaning blade at each crepe blade change, which is the historical practice. Using Setup B, cleaning the dryer included loading a new cleaning blade, loading a new crepe blade, loading the cleaning blade a second time, and finally, loading another new crepe blade. Setup A required significantly less effort to clean the dryer. Using Setup A, it was not necessary to install a new cleaning blade. Rather, the existing cleaning blade in place was loaded first and a new crepe blade was loaded second. Half the number of blade loadings and a third of the number of new blades were used to clean the dryer in Setup A as compared to Setup B. Using the polyethylene modifier of Setup A provided a reduction in blade loadings and the number of new blades required to clean the dryer which allowed the operation to run at a higher efficiency and reduced costs.

Additionally, the dryer surface in Setup A showed a more uniform coating than the dryer surface in Setup B. Setup B developed a more streaky dryer surface that indicated areas of adhesive that were hardening non-uniformly. In contrast, Setup A provided an adhesive layer that was more even across the width of the dryer. The polyethylene modifier provided an adhesive mixture with a more homogenous coverage across the surface of the dryer, thereby reducing the tendency of the adhesive to harden differentially across the width of the dryer.

According to another test on a second machine, in a third setup ("Setup C"), a 0.05% solids aqueous solution of a creping aid system comprising a creping adhesive and a polyethylene creping modifier was sprayed on the surface of a Yankee dryer. The creping aid system comprised about 65% creping adhesive and about 35% polyethylene creping modifier. The solids of the creping aid system, including the solids from both the creping adhesive and the creping modifier, comprised about 39% PAE Resin, about 10% plasticizer chemistry, about 27% polyethylene, and about 23% release agent. Thus, for example, about 49% by weight of the solids come from the creping adhesive product comprising PAE and/or plasticizers, and the remaining about 51% of the solids come from the polyethylene creping modifier comprising the polyethylene and/or other release agents. The ratios were balanced to produce good adhesion to the dryer surface yet still be able to release the sheet from the dryer. This application optimized the operation of the paper machine and the quality of the paper product produced on the second machine. A cellulosic fibrous web was pressed against the Yankee dryer surface and adhered to the drying surface. The dry web was removed from the drying surface with a doctor blade and was wound on a reel.

In a fourth setup ("Setup D"), a 0.05% solids aqueous solution of a creping aid system comprising a creping adhesive and a creping modifier without polyethylene was sprayed on the surface of a Yankee dryer. The creping aid system comprised about 42% creping adhesive and about 58% creping modifier without polyethylene. The solids of the creping aid system, including the solids from both the creping adhesive and the creping modifier, comprised about 10% PAE Resin, about 3% plasticizer chemistry, and about 88% release agent. Thus, for example, between about 13% by weight of the solids come from the creping adhesive product comprising PAE and/or plasticizers. The ratios were balanced to produce good adhesion to the dryer surface yet still be able to release the sheet from the dryer. This application optimized the operation of the paper machine and the quality of the paper product produced on the second machine. A cellulosic fibrous web was pressed against the Yankee dryer surface and adhered to the drying surface. The dry web was removed from the drying surface with a doctor blade and was wound on a reel.

Similar to the comparisons based on the setups used on the first machine, the comparisons based on the setups used on the second machine evidenced that using the polyethylene modifier of Setup C provided a longer blade life, required less effort and costs to clean the dryer and replace blades, and showed a more uniform coating than the dryer surface in Setup D.

Example 2

Tin Cup Studies

Film property evaluations were conducted by preparing solutions in glass vials which were mixed for 30 seconds. The ratios of the components were based on the total solids of the solution. Films were formed by weighing a mixture of each solution into an aluminum weighing dish that will dry to 0.5 grams of solids. The solutions were dried for 2 hours in an oven at 110° C. The dishes were removed from the oven and allowed to equilibrate to atmospheric conditions for 10 minutes prior to evaluations of dry tack, flexibility or hardness, and homogeneity.

Dry tack was evaluated as follows. After the oils were removed from the ball of the thumb of the tester using acetone, the thumb was pressed onto the film surface firmly. The thumb was lifted and it was noted whether the adhesive stuck to the thumb and the weighing dish either lifted off the table or stayed on the table. Those that stuck to the thumb and were lifted off the table for longer than 5 seconds were categorized as having excellent dry tack, less than 5 seconds were categorized as marginal dry tack and the samples that were not lifted from the table were categorized as poor dry tack. The samples including polyethylene showed improved dry tack characteristics over the samples without polyethylene. Improved dry tack enhances the paper making process by maintaining good adhesion between the web and the dryer.

Hardness was evaluated as follows. The tester used his index fingernail to scrape the dried adhesive samples in the aluminum dish. The tester would rate the hardness of the adhesive by how much force was required to scrape a portion of the adhesive from the dish. Samples that were not able to be scraped off the dish and were able to minimally mark the adhesive film were categorized as "hard." Samples that were able to be marked but were not fully removed from the dish were categorized as "moderate." Samples that could be scraped from the dish were categorized as "soft." Samples containing the polyethylene modifier were softer than samples without polyethylene. Increasing the softness of the adhesive film enhances the paper making process by reducing the costs associated with cleaning the dryer.

Homogeneity was evaluated by looking at the dried samples to see how uniform in color and texture the samples appear. Samples that were observed to have both liquid and solids were categorized as "not homogeneous." Samples that exhibited uniform solid characteristics were categorized as "homogeneous." Samples that contained polyethylene were more homogeneous than samples without polyethylene. Providing a more homogeneous mixture allows for a more uniform application of the creping aid system to the dryer, which enhances the paper making process by reducing the costs associated with waste paper and improper adhesion on the dryer.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for creping a fibrous web comprising:

providing a creping system, the creping system comprising a creping dryer, a creping adhesive, a creping modifier, and a fibrous web, the creping dryer comprising a creping cylinder having a surface, the fibrous web comprising a surface, and the creping modifier comprising a liquid and comprising from about 0.1% to about 70% by weight oxidized polyethylene, wherein the liquid comprises from about 40% to about 99% by weight water and the oxidized polyethylene is emulsified in the liquid; and applying the creping adhesive and the creping modifier to the surface of the creping cylinder, and pressing the fibrous web surface against the surface of the creping cylinder thereby causing sheet transfer and adhesion of the fibrous web to the surface of the creping cylinder.

2. The method of claim 1, further comprising a doctor blade configured to remove the fibrous web from the surface of the creping cylinder.

3. The method of claim 1, wherein the creping modifier modifies the tackiness of the creping adhesive when applied.

4. The method of claim 1, wherein the creping modifier modifies the softness of the creping adhesive when applied.

5. The method of claim 1, wherein the creping modifier comprises:

from about 5% to about 70% by weight solids oxidized polyethylene;

from about 10% to about 60% by weight solids mineral oil;

up to about 5% by weight solids cationic surfactant;

up to about 30% by weight solids nonionic surfactant.

6. The method of claim 1, wherein the oxidized polyethylene comprises from about 1% to about 50% of the total solids by weight of a mixture of the creping adhesive and creping modifier.

7. A method for creping a fibrous web comprising:

providing a creping system, the creping system comprising a creping dryer, a creping adhesive, a creping modifier, and a fibrous web, the creping dryer comprising a creping cylinder having a surface, the creping modifier comprising oxidized polyethylene, and the fibrous web comprising a surface, wherein the creping modifier comprises from about 0.1% to about 80% by weight solids oxidized polyethylene, from about 0% to about 60% by weight solids mineral oil, up to about 10% by weight solids cationic surfactant, and up to about 40% by weight solids nonionic surfactant; and applying the creping adhesive and the creping modifier to at least one of the creping cylinder surface and the fibrous web surface and pressing the fibrous web surface against the surface of the creping cylinder.

8. The method of claim 7, wherein the creping modifier comprises a liquid, and wherein the liquid comprises from about 40% to about 99% by weight water and the oxidized polyethylene is emulsified in the liquid.

9. The method of claim 7, wherein the creping modifier comprises:

from about 5% to about 70% by weight solids oxidized polyethylene;

from about 10% to about 60% by weight solids mineral oil;

up to about 5% by weight solids cationic surfactant;

up to about 30% by weight solids nonionic surfactant.

10. The method of claim 7, wherein the oxidized polyethylene comprises from about 0.1% to about 50% of the total solids by weight of a mixture of the creping adhesive and creping modifier.

11. The method of claim 7, wherein the oxidized polyethylene has a drop point of not greater than about 150° C.

12. A method for creping a fibrous web comprising:

providing a creping system, the creping system comprising a creping dryer, a creping adhesive, a creping modifier, and a fibrous web, the creping dryer comprising a creping cylinder having a surface, the creping modifier comprising oxidized polyethylene, and the fibrous web comprising a surface; and applying the creping adhesive to at least one of the creping cylinder surface and the fibrous web surface, and applying the creping modifier to at least one of the creping cylinder surface and the fibrous web surface, and pressing the fibrous web surface against the surface of the creping cylinder.

13. The method of claim 12, wherein the creping modifier comprises:

a liquid; and from about 0.1% to about 70% by weight of oxidized polyethylene.

14. The method of claim 12, wherein the creping modifier comprises:

from about 0.1% to about 80% by weight solids oxidized polyethylene;

from about 0% to about 60% by weight solids mineral oil;

up to about 10% by weight solids cationic surfactant;

up to about 40% by weight solids nonionic surfactant.

15. The method of claim 12, wherein the oxidized polyethylene comprises from about 1% to about 50% of the total solids by weight of a mixture of the creping adhesive and creping modifier.

16. The method of claim 12, wherein the creping modifier modifies the tackiness of the creping adhesive when applied.

17. The method of claim 12, wherein the creping modifier modifies the softness of the creping adhesive when applied.

* * * * *